United States Patent [19]

Carroll

[11] 4,394,807

[45] * Jul. 26, 1983

[54] SHEET METAL STRUCTURAL SHAPE

[76] Inventor: Frank E. Carroll, 237 Maple Rd., Barrington, Ill. 60010

[ * ] Notice: The portion of the term of this patent subsequent to Sep. 20, 1994, has been disclaimed.

[21] Appl. No.: 245,902

[22] Filed: Mar. 20, 1981

Related U.S. Application Data

[63] Continuation-in-part of Ser. No. 943,866, Sep. 19, 1978, which is a continuation-in-part of Ser. No. 762,778, Jan. 25, 1977, Pat. No. 4,114,335, which is a continuation-in-part of Ser. No. 648,500, Jan. 12, 1976, Pat. No. 4,048,777, which is a continuation-in-part of Ser. No. 457,996, Apr. 4, 1974, Pat. No. 3,965,641.

[51] Int. Cl.[3] ..... E04C 1/00

[52] U.S. Cl. ..... 52/332; 52/409; 52/732

[58] Field of Search ..... 52/309.9, 332, 333, 52/376, 408, 409, 434, 729, 731, 732, 738

[56] References Cited

U.S. PATENT DOCUMENTS

| | | | |
|---|---|---|---|
| 1,360,720 | 11/1920 | Brown et al. | 52/731 |
| 2,164,261 | 6/1939 | Small | 52/376 |
| 2,167,835 | 8/1939 | Greulich | 52/376 |
| 2,167,836 | 8/1939 | Grenlich | 52/376 |
| 3,256,670 | 6/1966 | Tersigni | 52/729 |
| 3,712,015 | 1/1973 | Nelson | 52/729 |
| 3,962,841 | 6/1976 | Carroll | 52/434 |
| 4,048,777 | 9/1977 | Carroll | 52/309.12 |

*Primary Examiner*—Peter M. Caun

*Attorney, Agent, or Firm*—Thomas W. Speckman

[57] ABSTRACT

A one-piece rollformed sheet metal structural shape for use in building construction, the shape being a generally triangular closed shape having mounting flanges extending outwardly at the bottom of the triangular shape and stiffening flanges extending outwardly from the opposite end of the shape, the stiffening flanges having a projection extending from the outer extremity of at least one of the stiffening flange(s) for increased stiffness. The stiffening projections may turn over or turn under or overlap the stiffening flanges for increased stiffness, prevention of moisture entering the interior of the shape, and securement of the stiffening flanges to each other providing greater strength to the shape.

18 Claims, 6 Drawing Figures

FIG-1
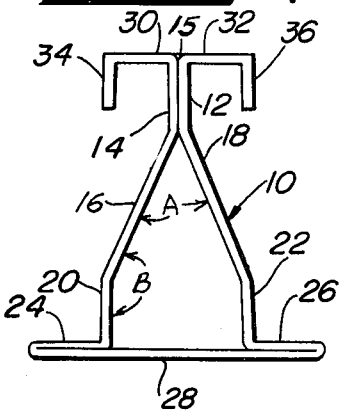
FIG-2
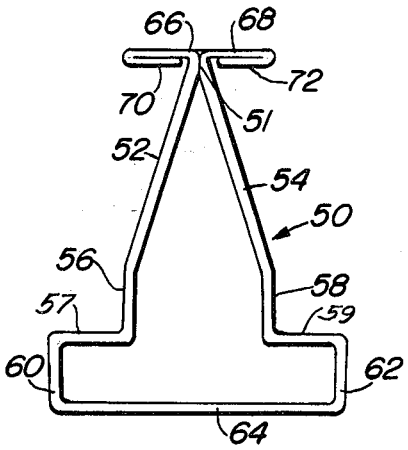
FIG-3
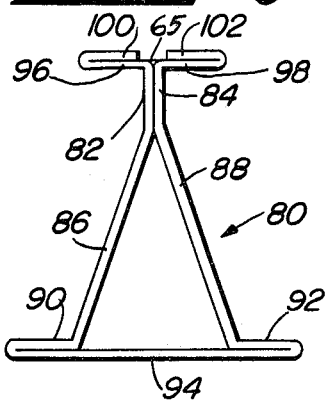
FIG-6
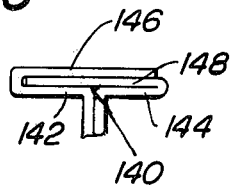
FIG-4
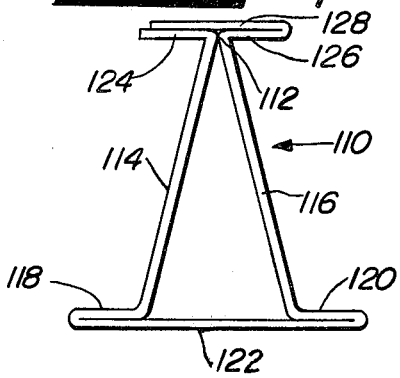
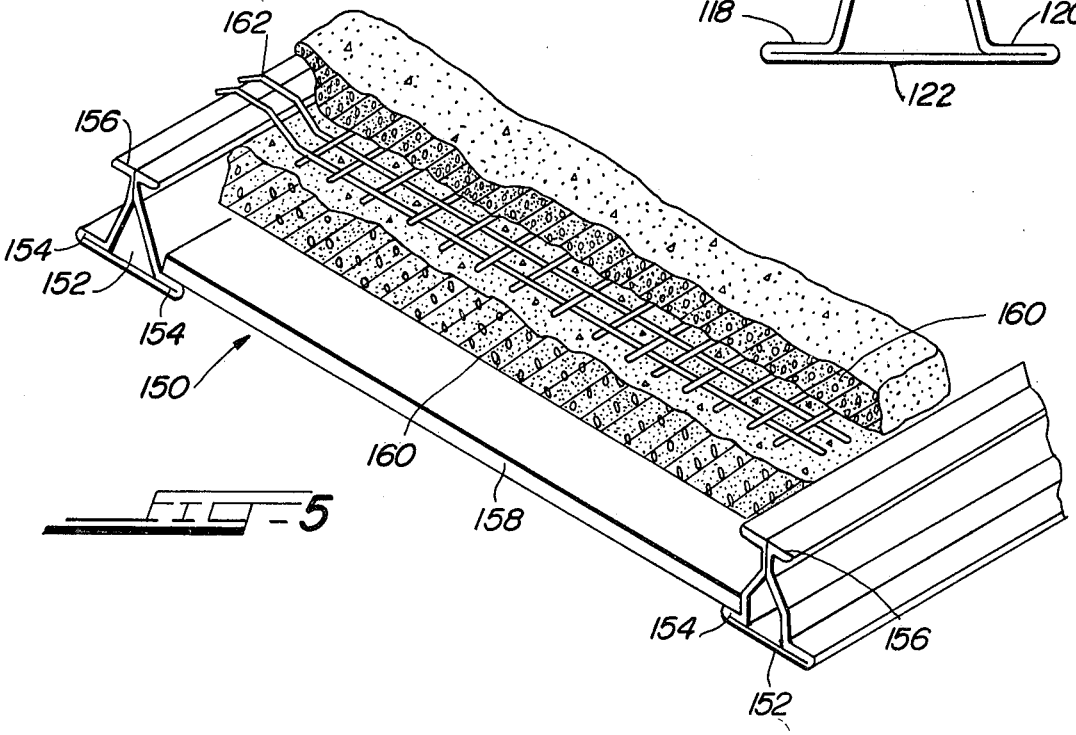
FIG-5

SHEET METAL STRUCTURAL SHAPE

CROSS REFERENCE TO RELATED APPLICATIONS

This application is a continuation-in-part of my copending earlier filed application, Ser. No. 943,866 filed Sept. 19, 1978, which was a continuation-in-part of my earlier filed application, Ser. No. 762,778, filed Jan. 25, 1977, now U.S. Pat. No. 4,114,335, which was a continuation-in-part of my earlier filed application, Ser. No. 648,500 filed Jan. 12, 1976, now U.S. Pat. No. 4,048,777, which was a continuation-in-part of my earlier filed application, Ser. No. 457,996, filed Apr. 4, 1974, now U.S. Pat. No. 3,965,641.

BACKGROUND OF THE INVENTION

1. Field of the Invention

This invention relates to a rollformed sheet metal structural shape fabricated from a single sheet of metal for use in building construction. The structural shape is particularly useful as a stud or mullion in wall construction or as a purlin or sub-purlin in deck construction. This invention also includes an interior deck or roof deck construction using the sheet metal structural shape of this invention.

2. Description of the Prior Art

Building interior and roof decks are generally constructed by securing a series of spaced structural shapes to the structural beams of the building with formboard or other suitable material placed between the structural shapes and covered with insulation or concrete. For weather-proof roof decks, a weather-proof roofing surface is secured to the top of the structural system. The shapes must be safe for workmen to walk on during construction, must resist both upward and downward environmental forces after the deck is assembled, and must not corrode during use. The shapes must be relatively inexpensive to manufacture, and easy to install, as well.

U.S. Pat. No. 1,360,720 describes a light weight metal bar structure useful as a spar in wings, fuselages, struts and the like in the construction of airplanes. The bar structures are symmetrical about both a vertical and a horizontal bisecting axis, and include an expanded shape on both ends of a center web which may bend if the structure is walked upon. The expanded shapes have equal length flanges at both the top and the bottom of the bar structure, which would make the structure difficult to install on a building beam from the top of the beam, and would make it very difficult for formboard and the like to be placed between the lower flanges of adjacent bar structures and have adequate support. The structure is also somewhat difficult to manufacture, as it is made of several pieces of sheet metal. West German Pat. No. 821,703 discloses several structural shapes which include a dominant center web portion, which also tends to "trip" or collapse if walked upon.

Thus, there is a need for one-piece structural shapes which do not bend over or collapse when walked upon during construction, are resistant to both upward and downward pressure created by the wind and other environmental forces, may be installed on building beams from the top of the beams, may be easily fitted with rigid formboard and the like on the lower flanges between adjacent structures, and do not corrode during use.

Accordingly, an object of this invention is to provide sheet metal structural shapes for use in building construction.

Another object of this invention is to provide sheet metal structural shapes which are especially useful as studs or mullions in building wall construction.

It is a further object of this invention to provide structural shapes which do not collapse or bend over when walked upon during building construction.

Yet another object of this invention is to provide structural shapes which do not corrode during use.

Still another object of this invention is to provide structural shapes which resist upward and downward forces and provide improved composite strength in a poured concrete deck.

A still further object is to provide structural shapes which may be installed on building beams from the top of the beams, and may be readily fitted with formboard between the bottom flanges of adjacent structures.

Yet another object is to provide structural shapes which may be rollformed from a single sheet of metal.

SUMMARY OF THE INVENTION

In keeping with one aspect of this invention, one-piece rollformed sheet metal structural shapes for use in building construction which are substantially symmetrical about a vertical bisecting plane include two symmetrical legs which extend downwardly from the plane from a point in the plane at the top of the shape. A mounting flange generally perpendicular to the bisecting plane extends outwardly from the lower extremity of each of the legs, and a stiffening flange generally perpendicular to the bisecting plane extends outwardly from each of the legs at the point in the plane at the top of the shape. The stiffening flanges are narrower than the distance between the outer ends of the mounting flanges. Projections on the outer extremities of either or both of the stiffening flanges may be provided which extend over the top of both flanges for increased stiffness, to prevent the entry of extraneous moisture into the interior of the shape, and for securement of the stiffening flanges to each other. The legs may include a central web extending downwardly along the bisecting plane a distance from the top point with the legs diverging outwardly from the bottom of the central web. Also, the legs may include two parallel portions at the lower extremities of the legs which are parallel to the bisecting plane. A closure extends across the bottom of the shape between the outer extremities of the mounting flanges. The structural shapes may be used in various deck systems, including a deck having formboard spanning the mounting flanges of adjacent structural shapes, and poured concrete covering the formboard and structural shapes, with wire reinforcing mesh in the concrete over the stiffening members of the shapes. The poured concrete decks according to this invention have excellent composite strength and uplift resistance.

BRIEF DESCRIPTION OF THE DRAWINGS

These and other objects, advantages and features of this invention will become apparent from the description, and by reference to the drawings, wherein preferred embodiments are shown as follows:

FIG. 1 is an end view of a structural shape according to one embodiment of this invention;

FIG. 2 is an end view of another embodiment of a shape of this invention;

FIG. 3 is an end view of another embodiment of a shape of this invention;

FIG. 4 is an end view of yet another embodiment of a shape of this invention;

FIG. 5 is a perspective view of a concrete deck using the shapes of this invention; and FIG. 6 is a partial end view of another embodiment of the stiffening member of the structural shape of this invention.

DESCRIPTION OF THE PREFERRED EMBODIMENTS

As shown in FIG. 1, structural shape 10 includes two symmetrical legs 16, 18 which extend downwardly from a point 15 at the top of the shape. The entire shape 10 is substantially symmetrical about a vertical bisecting plane which passes through point 15. Mounting flanges 24, 26 extend outwardly from the lower extremity of each leg 16 and 18, and stiffening flanges 30 and 32 extend outwardly from each leg 16, 18 at point 15. Stiffening flanges 30 and 32 are narrower than the distance between the outer extremities of the mounting flanges 24, 26. Projections 34, 36 extend downwardly from the outer ends of flanges 30, 32 for added stiffness and support as well as adding to the composite strength of poured concrete decks.

Legs 16, 18 include a central web 12, 14 extending downwardly from point 15. The legs, for at least a major portion of their lengths, diverge outwardly from the bottom of the web 12, 14 for equal lengths at an included angle, shown in FIG. 1 as "A", of about 30° to about 90°.

Legs 16, 18 also include substantially parallel portions 20 and 22 projecting downwardly at their lower extremities at the angle "B", portions 20, 22 are substantially parallel and are substantially parallel to the bisecting plane. The bottom of the shape 10 is enclosed by closure 28, which extends across the bottom of shape 10 between the outer extremities of each of the mounting flanges 24, 26.

Another embodiment of the sheet metal shape of this invention is shown in FIG. 2, wherein closure 64 is spaced from mounting flanges 57, 59 by box sides 60, 62 which are parallel to the bisecting plane. Box sides 60, 62 extend downwardly from flanges 57, 59 respectively, and closure 64 extends between the outer extremities of the mounting flanges at the lower end of box sides 60, 62. Shape 50 is symmetrical about a bisecting plane through the point 51. Legs 52, 54 project downwardly diverging from each other for equal lengths from point 51, and parallel portions 56 and 58 project downwardly parallel to the bisecting plane at the lower extremities of legs 52 and 54. Mounting flanges 57 and 59 extend outwardly from the lower extremities of legs 52 and 54 with parallel portions 56, 58. Shape 50 includes stiffening flanges 66 and 68 which extend outwardly from point 51, and projections 70 and 72 which extend from and are turned beneath stiffening flanges 66 and 68 for added stiffness and stronger material for receiving mechanical fastenings. Stiffening flanges 66 and 68 are narrower than the distance between the extremities of mounting flanges 57 and 59.

Structural shape 80, shown in FIG. 3, includes legs 86 and 88 which extend from point 65 in a vertically bisecting plane to mounting flanges 90, 92. Mounting flanges 90, 92 extend outwardly from the lower extremities of diverging legs 86 and 88, and closure 94 extends between the outer extremities of flanges 90, 92. Legs 86 and 88 include a central web 82, 84 which extends downwardly from point 65. Legs 86, 88 diverge outwardly from the bottom of the central web. Stiffening flanges 96, 98 extend outwardly from point 65, and projections 100 and 102 extend from the outer ends of and over stiffening flanges 96, 98 for added stiffness and to provide a better fastening base for mechanical fasteners.

FIG. 4 shows an embodiment of the structural shape of this invention which does not have a central web or parallel portion of the legs. Shape 110 includes legs 114 and 116, which diverge downwardly for their full length from point 112 in a vertically bisecting plane. Mounting flanges 118 and 120 extend outwardly from legs 114 and 116 at their lower extremities, and closure 122 extends from the outer extremities of mounting flanges 118 and 120. Stiffening flanges 124 and 126 extend outwardly from legs 114 and 116 at point 112, and a single projection 128 extends from the outer extremity of stiffening flange 126, turned over both stiffening flanges 126 and 124.

FIG. 6 shows a stiffening flange configuration which may be used on any of the shapes of this invention. Stiffening flanges 142 and 144 extend from point 140, the point at the top of the shape in the vertical bisecting plane of the shape. First projection 148 extends from the outer end of flange 144 and over both stiffening flanges 144 and 142. Second projection 146 extends from the outer end of flange 142 and over projection 148 extending over both stiffening flanges 142 and 144.

FIGS. 1 through 4, and 6 are meant to illustrate various embodiments of components of the rollformed sheet metal structural shape of this invention and each component may be used in combination with any other component. For example, the shapes may or may not have the central web as shown in FIGS. 1 and 2, respectively, the shapes may or may not have the parallel portions at the lower extremities of the legs as shown in FIGS. 1 and 3, respectively, the shapes may or may not have the closure spaced from the mounting flanges as shown in FIGS. 2 and 1, respectively. The stiffening flange configuration of any of FIGS. 1–4 and 6 may be used on any of the shapes of this invention. One preferred combination of components is shown in FIG. 1. Another preferred combination of components is the shape shown in FIG. 1 with stiffener configuration shown in FIG. 2 or FIG. 4. The sheet metal structural shapes of the present invention may be directly substituted for the structural shapes in the wall and deck systems disclosed in my co-pending application Ser. No. 943,866, filed Sept. 19, 1978, and my additional related applications, now U.S. Pat. Nos. 3,965,641; 4,048,777; and 4,114,335.

When the stiffening flange configuration shown in FIG. 4 or FIG. 6 is used, moisture will be substantially prevented from entering the inside of the structural shapes, which aids in prevention from corroding during use. In addition, when mechanical fastenings, such as screws, are inserted through stiffener 124 and projection 128, the shape 110 will be secured together, and legs 114 and 116 will not tend to spread under loading.

Parallel portions 20 and 22 in FIG. 1 provide greater resistance to deflection along the plane of web 12, 14 to suit desired design characteristics and provide accommodation for placing components of varying thicknesses in both wall and deck construction. The central web formed by upper portions 12 and 14 of legs 18 and 16 is important for increased load carrying characteristics, but must be no higher than one half the vertical height of the diverging portion of the legs and preferably no greater than $\frac{5}{8}$ inch when the shape is to be used as a sub-purlin. Otherwise, when walked upon, the light gauge shape will tend to "trip" or bend at the bottom of the web creating dangerous conditions. Closure 28 prevents mounting flanges 24 and 26 from spreading, and provides an internal raceway for wires, pipes and the like as well as ducts for distributing conditioned air through a building structure and drying or draining accumulated moisture from the deck structure. In cases of use for air distribution and drying, openings may be cut in desired locations in the shape and a suitable manifold system located at each end of the shape for forced flow. Also, in poured deck construction, the volume inside the shapes may be filled with concrete.

The dimensions of the elements of the various embodiments of the shapes of this invention are generally the same. The mounting flanges are about $\frac{1}{2}$ to about 1 inch long to provide suitable surface for receiving insulation or deck or wall structural components. The vertical height of the diverging portions of the legs may be varied to suit the strength requirements of the desired span. The vertical height of the diverging portion of the legs is the major portion, more than one half, their length. About $1\frac{1}{8}$ to about 4 inches is satisfactory when using the shapes as sub-purlins, studs or mullions and about 4 to about 10 inches is satisfactory when using the shapes for purlins or other major structural members. The included angle of the diagonal legs is suitably 30° to about 90°, and is preferably about 30° to about 60°. The web, if used, supplies resistance to forces at right angles to the longitudinal axis of the shape and also prevents bending or rolling of the shapes when they are used in deck structures and walked upon by erection workers. The central web is less than one half the vertical height of the diverging portions of the legs and suitably may be about $\frac{3}{8}$ to $\frac{5}{8}$ inches long, preferably about $\frac{1}{2}$ inch. The height of the parallel portions of the legs, if used, may be varied to suit strength requirements of desired spans, generally about $\frac{3}{8}$ to about $\frac{3}{4}$ inch is satisfactory when using the shapes as sub-purlins, studs or mullions. When using heavier gauge shapes for purlins or other major structural members, or to increase wall or deck thickness for insulation, the height may be increased to as much as about 4 inches.

Box sides 60 and 62, as shown in FIG. 2, may be any suitable length to provide desired structural characteristics. Box sides of about $\frac{1}{2}$ to about 2 inches are preferred. With the box sides 60 and 62 shown in FIG. 2, screws used in building walls are completely enclosed in the box section of the structural shape.

The stiffening flanges may be any suitable length narrower than the distance between the outer extemities of the mounting flanges and are generally each about $\frac{3}{8}$ to about $\frac{3}{4}$ inches long. The projections shown in FIG. 1 are between about $\frac{1}{4}$ and $\frac{3}{4}$ inches long. The configuration of the stiffening flanges should permit poured concrete or grouting to flow both under and over the flanges to prevent vertical displacement or uplift when the shape is used in deck construction.

The sheet metal sections of this invention may be fabricated by rollforming techniques, known and readily apparent to one skilled in the art, from a single sheet of metal of about 12 gauge to about 25 gauge, about 16 to 22 gauge being suitable for sub-purlins, about 12 to 16 gauge being suitable for purlins, about 20 to 25 gauge being suitable for interior wall studs, and about 12 to 20 gauge being suitable for exterior wall mullions.

Any of the shapes shown herein may be used in decks or wall structures of various kinds. FIG. 5 shows a poured reinforced concrete deck structure 150, which includes a spaced series of parallel sheet metal structural shapes 152 as sub-purlins. Moisture permeable formboard 158 may easily be installed on flanges 154 of adjacent structural shapes 152, and concrete may be poured adjacent the upper side of formboard 158 and around stiffening flanges 156. Wire mesh 162 may be provided in the poured concrete across stiffening flanges 156 for reinforcement.

The concrete may be poured to a thickness of about $1\frac{1}{2}$ to about 3 inches over the stiffening flanges of the structural shape sub-purlins. The concrete utilized may be preferably standard gypsum concrete. However, modified concretes containing various fillers such as perlite aggregate for thermal insulation and lighter weight are suitable. Exploded mica in portland cement is suitable for the roof structure of this invention. The gypsum concrete is especially desirable for use in roof structures not only because it is incombustible but also because the gypsum sets within a few minutes to form a slab that is hard enough to walk upon, thereby permitting, in many cases, a water-proof wearing surface to be laid the same day the slab is poured.

Light weight concrete may also be used. When any type of portland cement is used, the setting time is much slower and to prevent moisture from sagging the formboard, I have found it may be desirable to place a moisture permeable sheet between the cement and the top surface of the formboard. To further assist in drying, the legs of the structural shapes may be perforated to facilitate mositure passage, and the bottom of the structural shapes may be perforated for passage of moisture to the space below or the shapes may be ventilated through their ends.

The structure shown in FIG. 5 provides for direct substitution of the sub-purlin shapes of this invention for conventional bulb tees and truss tees. The deck structure shown in FIG. 5 results in unexpected composite resistance to vertical loading and uplift resistance while providing an unexpectedly fire resistant structure.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A rollformed sheet metal structural shape fabricated from a single sheet of metal for use in building construction, said shape being substantially symmetrical about a vertical bisecting plane, said shape comprising two symmetrical legs extending from a point in said plane at the top of said shape downwardly, said legs extending away from said plane forming an included angle of about 30° to about 90° between said legs, said legs having a vertical height of about $1\frac{1}{8}$ to about 10 inches;

a mounting flange generally perpendicular to said plane extending outwardly from the lower extremity of each of said legs;

a stiffening flange generally perpendicular to said plane extending outwardly from each of said legs at said point; said stiffening flanges being narrower than the distance between the outer extremity of said mounting flanges and having a projection extending from the outer extremity of at least one of said stiffening flange(s) for increased stiffness; and a closure extending across the bottom of said shape from the outer extremity of each of said mounting flanges.

2. The structural shape of claim 1 wherein said legs comprise a central web extending downwardly along said plane a predetermined distance from said point, said legs extending outwardly from the bottom of said central web.

3. The structural shape of claim 2 wherein said central web is about $\frac{3}{8}$ to about $\frac{5}{8}$ inch.

4. The structural shape of claim 2 wherein said legs comprise two parallel portions at the lower extremities of said legs.

5. The structural shape of claim 4 wherein said parallel portions are about $\frac{3}{8}$ to about 4 inches.

6. The structural shape of claim 1 wherein said legs comprise two parallel portions at the lower extremities of said legs.

7. The structural shape of claim 6 wherein said parallel portions are about $\frac{3}{8}$ to about 4 inches.

8. The structural shape of claim 1 wherein said included angle is about 40° to about 60°.

9. The structural shape of claim 1 wherein said legs have a vertical depth of about $1\frac{1}{8}$ to about 4 inches.

10. The structural shape of claim 1 wherein said closure is spaced from said mounting flanges by box sides extending from the extremity of each said mounting flange to each end of said closure side.

11. The structural shape of claim 10 wherein said box sides are about $\frac{1}{2}$ to about 2 inches.

12. The structural shape of claim 1 wherein said projection extends downwardly from the outer ends of each said stiffening flanges.

13. The structural shape of claim 1 wherein said projection extends from and turning beneath each said stiffening flanges.

14. The structural shape of claim 1 wherein said projection extends from and over at least one of said stiffening flanges.

15. The structural shape of claim 1 wherein said projection comprises a single projection extending from the outer extremity of one of said stiffening flanges, and over both of said stiffeneing flanges.

16. The structural shape of claim 1 wherein said projection comprises a first projection which extends from the outer extremity of the first of said stiffening flanges, said first projection extending over both of said stiffening flanges, and a second projection extending from the outer extremity of the second of said stiffening flanges, said second projection extending over said first projection.

17. A building deck structure comprising:

a spaced series of parallel sheet metal structural shapes which are symmetrical about a vertical bisecting plane having two symmetrical legs extending from a point in said plane at the top of said shape downwardly, said legs extending away from said plane forming an included angle of about 30° to about 90° between said legs, said legs having a vertical height of about $1\frac{1}{8}$ to about 10 inches;

a mounting flange generally perpendicular to said plane extending outwardly from the lower extremity of each of said legs;

a stiffening flange generally perpendicular to said plane extending outwardly from each of said legs at said point; said stiffening flanges being narrower than the distance between the outer extremity of said mounting flanges and having a projection extending from the outer extremity of at least one of said stiffening flange(s) for increased stiffeners;

a closure extending across the bottom of said shape from the outer extremity of each of said mounting flanges;

moisture permeable formboard resting on said mounting flanges and extending between adjacent structural shapes; and poured reinforced concrete adjacent the upper side of said formboard and around said stiffening members.

18. The building deck structure of claim 17 wherein said reinforced concrete comprises wire mesh in said poured concrete.

* * * * *